United States Patent [19]

Larson et al.

[11] 4,158,467

[45] Jun. 19, 1979

[54] PROCESS FOR RECOVERING SHALE OIL

[75] Inventors: Olaf A. Larson, Pittsburgh, Pa.; Charles W. Matthews, Denver, Colo.

[73] Assignee: Gulf Oil Corporation, Pittsburgh, Pa.

[21] Appl. No.: 865,916

[22] Filed: Dec. 30, 1977

[51] Int. Cl.[2] ..... E21B 43/24; E21C 41/10

[52] U.S. Cl. ..... 299/2; 166/259; 166/261

[58] Field of Search ..... 299/2; 166/256, 259, 166/267, 261

[56] References Cited

U.S. PATENT DOCUMENTS

| | | | |
|---|---|---|---|
| 3,661,423 | 5/1972 | Garret | 299/2 |
| 3,994,343 | 11/1976 | Cha et al. | 166/259 |
| 4,014,575 | 3/1977 | French et al. | 299/2 |
| 4,082,146 | 4/1978 | Compton et al. | 299/2 X |

OTHER PUBLICATIONS

"Schematic Drawing Showing Processing and Utilization of Sour Gas", The Oil Weekly, 9-21-42, p. 19.

*Primary Examiner*—Ernest R. Purser

[57] ABSTRACT

An improved process for recovering shale oil from in-situ shale comprising the steps of: (1) mining a first portion of said shale; (2) fragmenting a second portion of said shale; (3) introducing into said second portion a mixture of gases comprising a molecular oxygen supplying gas, carbon dioxide and hydrogen sulfide while maintaining a temperature sufficient to convert kerogen in said second portion to shale oil and to produce carbon dioxide, hydrogen sulfide, gaseous hydrocarbons and other combustion and inert gases; (4) separating said shale oil from an offgas containing said carbon dioxide, hydrogen sulfide, gaseous hydrocarbons and other combustion and inert gases; (5) separating hydrogen sulfide and a first portion of carbon dioxide from a gas of low sulfur content and increased heating value comprising said gaseous hydrocarbons and other combustion and inert gases and a second portion of said carbon dioxide; and (6) recycling said hydrogen sulfide and said first portion of said carbon dioxide to step (3).

13 Claims, 1 Drawing Figure

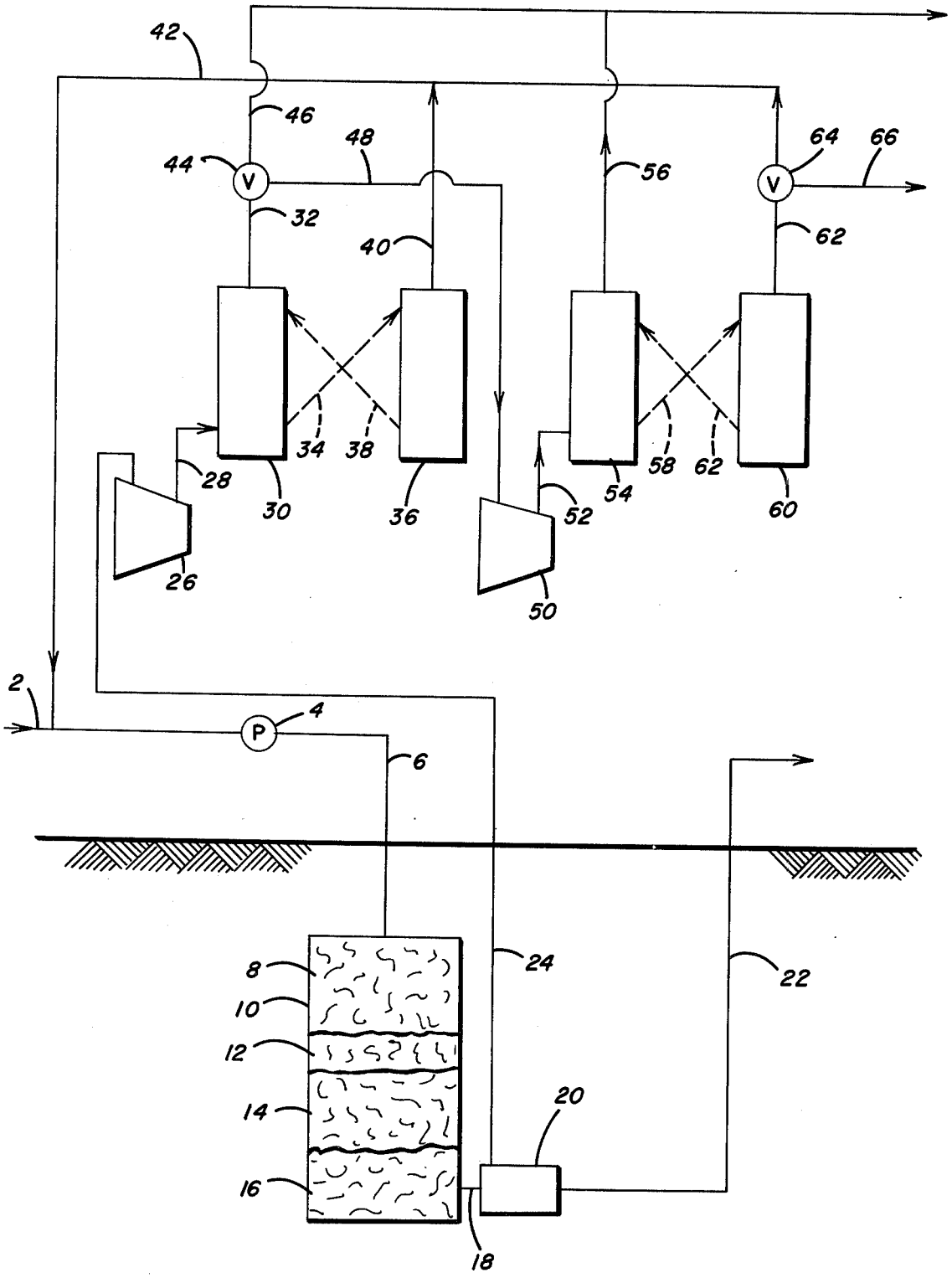
42
46
48
44
V
32
40
56
64
66
V
62
34
38
28
30
36
58
62
54
52
60
26
50
2
P
4
6
8
10
12
14
16
24
22
20
18

PROCESS FOR RECOVERING SHALE OIL

BACKGROUND OF THE INVENTION

1. Field of the Invention

This invention relates to a process for recovering shale oil from an in-situ share retort, and more particularly to a process for returning hydrogen sulfide and a portion of the carbon dioxide separated from the shale oil along with a molecular oxygen-supplying gas to the retort for oxidation to sulfur oxide compounds which then react with spent and/or retorted shale.

Shale deposits in the Western States of the United States extend over thousands of square miles and are more than a thousand feet thick in some areas. Shale contains kerogen, a solid carbonaceous material which on heating to a temperature above 427° C. yields shale oil. The shale deposits can produce from about 15 to about 80 gallons of shale per ton of shale. By retorting is meant heating a carbonaceous material to about 427° C. so as to produce liquid and gaseous product by cracking and distillation reactions.

One method of recovering shale oil from shale is to treat shale at high temperatures in retorts located at the ground surface. Because of the expense of underground mining of shale, it is preferred to retort shale in-situ. A problem that confronts in-situ retorting of shale is the disposal of harmful pollutant gases, such as, for example, hydrogen sulfide, carbonyl sulfide, mercaptans and carbon disulfide given-off during the combustion and/or retorting processes. Presently, shale technology generally calls for the recovery by complex and expensive technology of these pollutant gases to prevent their release into the atmosphere.

Green River shale contains from 0.6 to 0.7 percent by weight total sulfur (Stanfield, K. E., Frost, I. C., McAuley, W. S. and Smith, H. N., "Properties of Colorado Oil Shales," Bureau of Mines Report of Investigations 4825, 1951). A more detailed analysis of organic sulfur and pyrite sulfur present in Colorado shale is reported in RI 5725 (Smith, John Ward, "Ultimate Composition of Organic Material in Green River Oil Shale," Bureau of Mines Report of Investigations 4825, 1961). An average of 10 cored samples in Colorado and Utah oil shale showed a total sulfur (organic plus pyrite) of 0.63 percent by weight. The organic content of the cores averaged 14.1 percent, and this organic fraction contained 1.0 percent sulfur. Thus, 22 percent of the sulfur is organic sulfur and the remaining 78 percent is essentially inorganic sulfur.

"Revised Detailed Development Plan, Tract C-a Volume I," submitted to Area Oil Shale Supervisor Geological Survey, U.S. Department of the Interior, pp. i, iii and iv, describes a commercial plan for retorting 170,000 tons of shale per day which would produce 265 tons of sulfur per day. Some of the sulfur in the shale does not decompose and a portion ends up in the liquid product, but is is estimated that from 20 to 75 percent of the total sulfur present in the in-situ shale can end up in the gas.

Retorting with air produces fuel gases which are contaminated with the sulfur gases and, in addition, produces fuel gases which contain from 85 to 90 percent of inert gases such as, for example, nitrogen and carbon dioxide. Typical heating values of the gas are only about 35 to about 65 Btu/SCF, which makes such gases difficult to use in combustion processes or gas turbines except by resorting to supplemental fuel. If the fuel gas can be upgraded to about 80 to about 100 Btu/SCF, supplemental fuel is not needed. Carbon dioxide can be removed from gases to improve heating value, and sulfur gases can be concentrated and processed by surface processes to give elemental sulfur as a product. However, removal of hydrogen sulfide which is recovered as elemental sulfur and upgrading of the fuel gases by removal of carbon dioxide so it can be burned can be very complex and expensive. One process commonly used for removing hydrogen sulfide and carbon dioxide is called the hot potassium carbonate process which was developed by the U.S. Bureau of Mines for removing acid gases from coal synthesis gas.

It has been discovered that a selective process can first be employed to absorb substantially all of the hydrogen sulfide and a portion of the carbon dioxide using a selective hot carbonate process. In a preferred embodiment a portion of the hydrogen sulfide-free gas can then be cleaned substantially completely of carbon dioxide, and this carbon dioxide-free gas is blended with the hydrogen sulfide-free gas to give a fuel gas which can be satisfactorily burned whithout polluting the atmosphere. The recycling of the hydrogen sulfide-containing gas and the processing sequence for scrubbing the off-gases gives an optimum solution to a difficult problem.

Consequently, a need exists for a simpler process for removing pollutant gases, in particular, hydrogen sulfide. In accordance with the invention herein, an improved process is provided for recovering shale oil from in-situ shale comprising the steps of: (1) mining a first portion of said shale; (2) fragmenting a second portion of said shale; (3) introducing into said second portion a mixture of gases comprising a molecular oxygen-supplying gas, carbon dioxide and hydrogen sulfide while maintaining a temperature sufficient to convert kerogen in said second portion to shale oil and to produce carbon dioxide, hydrogen sulfide, gaseous hydrocarbons and other combustion and inert gases; (4) separating said shale oil from said carbon dioxide, hydrogen sulfide, gaseous hydrocarbons and other combustion and inert gases; (5) separating said hydrogen sulfide and a first portion of said carbon dioxide from said gaseous hydrocarbons and other combustion and inert gases and a second portion of said carbon dioxide; and (6) recycling said hydrogen sulfide and said first portion of said carbon dioxide to step (3).

2. Description of the Prior Art

Unlike the invention herein, U.S. Pat. No. 2,630,307 to Martin relates to a method of recovering oil from in-situ oil shale by destructively distilling oil shale using a combustion supporting gas containing carbon dioxide and oxygen in a critical ratio.

SUMMARY OF THE INVENTION

We have discovered an improved process for recovering shale oil from in-situ shale comprising the steps of:

(1) mining a first portion of said shale;

(2) fragmenting a second portion of said shale;

(3) introducing into said second portion a mixture of gases comprising a molecular oxygen-supplying gas, carbon dioxide and hydrogen sulfide while maintaining a temperature sufficient to convert kerogen in said second portion to shale oil and to produce carbon dioxide, hydrogen sulfide, gaseous hydrocarbons and other combustion and inert gases;

(4) separating said shale oil from said carbon dioxide, hydrogen sulfide, gaseous hydrocarbons and other combustion and inert gases;

(5) separating said hydrogen sulfide and a first portion of said carbon dioxide from said gaseous hydrocarbons and other combustion and inert gases and a second portion of said carbon dioxide; and (6) recycling said hydrogen sulfide and said first portion of said carbon dioxide to step (3).

BRIEF DESCRIPTION OF THE DRAWING

FIG. 1 is a schematic diagram of the process of the invention herein.

DETAILED DESCRIPTION OF PROCESS

In an underground deposit a first portion of in-situ shale, usually from about 10 to about 50, preferably from about 15 to about 30, percent by volume of the total shale to be treated is mined by conventional mining techniques such as, for example, room and pillar, long wall, block or panel caving and induced or forced caving. Shale which has been mined according to these techniques can be then processed at the ground surface if desired. Although in-situ retorts in the present invention can have either a vertical or horizontal configuration, a vertical configuration is preferred for operational simplicity with respect to flow of gas through the retort.

A second portion of said shale, usually from about 50 to about 90, preferbly from about 70 to about 85 percent by volume of the total said shale is fragmented or rubblized by any of a number of known techniques, such as, for example, those described in U.S. Pat. No. 2,481,051 to Uren, U.S. Pat. No. 1,919,636 to Karrick, and U.S. Pat. No. 3,661,423 to Garrett to provide an in-situ retort. Preferred techniques from the standpoint of more uniform fragment size are blasting and mechanical breakage. After the shale has been fragmented, the fragmented portion of the shale will have a void space of at least about 15 percent, but will generally range from about 10 to about 50 volume percent, an amount adequate for permeability.

At start-up, shale in the top part of the retort is heated by gas from another retort or by burners or by hot combustion gas from burning gas, oil, charcoal or wood until retorting temperature is attained. A uniform flow of oxygen or air, preferably in mixture with an inert gas such as steam or carbon dioxide, is introduced to the top of the retort to sustain combustion of the retorted products. Gradually a fairly well defined combustion zone develops near the top of the retort where the carbonaceous residue of retorting is burned with oxygen. The heat from the combustion zone is carried downward in the retort by combustion gases and by the heated inert gas. Another fairly well defined retorting zone develops deeper in the retort beneath the combustion zone. As in-situ retorting progresses, the combustion and the retorting zones move deeper into the retort but the relative portions of the zones are unchanged. The material remaining above the combustion zone is called spent shale. The spent shale zone contains shale that has been retorted and the carbonaceous residue from retorting has been partially combusted. The temperature of the spent shale zone will range from combustion zone temperature down to the temperature of the input gases.

Thus thereafter a mixture of gases comprising a molecular oxygen-supplying gas, carbon dioxide and hydrogen sulfide is introduced into the fragmented or second portion of shale in the retort and, in particular, into areas of the retort known as the spent shale zone and the combustion zone, at such rate to maintain a temperature sufficient to convert kerogen in the fragmented second portion to shale oil and to produce carbon dioxide, hydrogen sulfide, gaseous hydrocarbons and other combustion and inert gases. Suitable molecular oxygen-supplying gasses can include, for example, air, oxygen and a mixture of oxygen with air or other gases such as, for example, nitrogen. When air is used in the invention herein, the nitrogen contained in the air will pass through the retort as an inert gas. A preferred molecular oxygen-supplying gas is oxygen. Carbon dioxide used in the present invention is produced by the retorting process from the decomposition of organic materials, such as kerogen, and from the decomposition of mineral carbonates and combustion as described herein. Hydrogen sulfide, along with small amounts of other sulfur containing compounds such as, for example, carbonyl sulfide, mercaptans and carbon disulfide, employed herein is formed during the retorting process. It is this hydrogen sulfide that is separated from the gas stream downstream and recycled to step (3) herein.

The hydrogen sulfide is introduced into the retort along with carbon dioxide and a molecular oxygen-supplying gas. The mixture of gases comprising a molecular oxygen-supplying gas, carbon dioxide and hydrogen sulfide is introduced into the retort under the conditions set forth in Table 1.

Table 1

| | Process Conditions | |
|---|---|---|
| | Broad Range | Preferred Range |
| Retort Temperature, °C. | 425 to 1150 | 300 to 600 |
| Pressure, psia (kg/cm$^2$) | 2 to 100 (0.14 to 7.0) | 2 to 30 (0.14 to 2.10) |
| Gas Flow Rate, SCF/ton of shale retorted | 5,000 to 20,000 | 7,000 to 15,000 |
| Molar Ratio $O_2$:$CO_2$:$H_2S$ | 10:20:0.05 to 30:65:0.30: | 12:25:0.05 to 18:35:0.30 |
| Molar Ratio Air:$CO_2$:$H_2S$ | 15:20:0.05 to 100:65:0.30 | 17:25:0.05 to 88:35:0.30 |

Hydrogen sulfide is believed to be oxidized in the retort according to the following reactions:

$$H_2S + 3/2\ O_2 \rightleftharpoons SO_2 + H_2O \quad (1)$$

$$SO_2 + \tfrac{1}{2} O_2 \rightleftharpoons SO_3 \quad (2)$$

Sulfur oxides are believed to react with the decomposition products of inorganic carbonates contained in spent shale such as, for example, decomposition products of calcite and dolomite, in the combustion zone. Sulfur trioxide is fixed as calcium sulfate according to the following reactions:

$$CaCo_3.\ MgCO_3 \rightleftharpoons CaO.MgCo_3 + CO_2 \quad (3)$$

$$CaO.MgCO_3 + SO_3 \rightarrow CaSO_4.MgCO_3 \quad (4)$$

Temperature, residence time and calcium to sulfur ratio are some of the factors which determine the amount of sulfur fixed or captured by the calcium oxide. Conditions necessary for fixing sulfur with calcium oxides are given in detail by Ehrlich, Sheldon, Fluidized Combustion Conference, Proceedings of the Institute of Fuel, (London: 1975), pp. C4-10 and Nogel, G. T. Swift, W. M. Montagna, J. C. Lenc, J. F. and Jonke, A. A., Fluidized Combustion Conference, Proceedings of the Institute of Fuel, (London: 1977), pp. D3-9 to D3-11, and coincide with conditions present in retorting process of this invention. Hydrogen sulfide is formed downstream of the combustion and/or retort zone, and its recovery is accomplished by the process of the invention herein.

As the combustion and/or retorting zone moves downward through the fragmented portion of shale, liquid and vapor shale oil, carbon dioxide, hydrogen sulfide, gaseous hydrocarbons and other combustion and inert gases formed by the process described herein flow downward also and are cooled as they come into contact with cooler, unretorted shale. In the process of the invention herein, liquid and vapor shale oil are separated from carbon dioxide, hydrogen sulfide, gaseous hydrocarbons and other combustion and inert gases. Separation of the shale oil, especially shale oil in vapor form which comprises high molecular weight hydrocarbons, from the carbon dioxide, hydrogen sulfide, gaseous hydrocarbons and other combustion and inert gases will generally occur when contacted with fragmented shale which is at a lower temperature than the vapor dewpoint of the shale oil vapor. A vapor dewpoint of a compound is defined as the temperature at which the vapor begins to condense or liquify; and for shale oil vapor is generally lower than about 150° C.

Gases collectively leaving the retort are called "off-gas" and generally have a low heating value such as, for example, about 35 to about 65 Btu/SCF due to an abundance of inert gases such as nitrogen and carbon dioxide. For convenience herein, off-gas of the present invention is comprised of carbon dioxide, hydrogen sulfide, gaseous hydrocarbons and other combustion and inert gases. Gaseous hydrocarbons can include such gases as, for example, methane, ethane and propane which are formed during the retorting process. Other combustion and inert gases can include such gases as, for example, nitrogen, carbon monoxide and water vapor. Carbon dioxide, usually a portion thereof, and hydrogen sulfide are separated from the gaseous hydrocarbons and other combustion and inert gases above ground by compressing all of the gas preferably to about 45 to about 100 psig, usually about 30 to about 1000 psig, followed by a process which is selective for carbon dioxide and hydrogen sulfide removal. Such a process is known as a hot potassium carbonate process as described, for example, in U.S. Pat. No. 2,886,405 to H. E. Benson et al which discloses a method for removing carbon dioxide and hydrogen sulfide using a scrubbing solution which is continuously recycled between an absorption column and a regeneration column. It is preferred to operate a first absorber under conditions so that essentially total hydrogen sulfide is removed with only partial carbon dioxide removal. Typically, for example, 90 to about 100, preferably about 95 to about 99.5 percent hydrogen sulfide and about 20 to about 70 percent, preferably about 40 to about 60 percent carbon dioxide can be removed by a suitable set of conditions for the hot potassium carbonate process.

A typical off-gas from a retort using air as the molecular oxygen-supplying gas and initially containing approximately 50.8 percent carbon dioxide and 0.2 percent hydrogen sulfide, for example, leaves a first absorber as a lean, clean fuel gas containing 43.7 percent carbon dioxide and essentially no hydrogen sulfide. Clean fuel gas is defined as sulfur-free gas. A lean fuel gas is defined as having a carbon dioxide content about 25 percent lower than the gas which initially entered the absorber. Acid gas, a mixture of carbon dioxide and hydrogen sulfide, is removed from a first regenerator and recycled to the retort. All of the acid gas from the first regenerator, up to about 50 percent of the total off-gas, preferably from 10 to 30 percent by volume, is recycled to the retort where it is mixed with a molecular oxygen supplying gas. A remainder portion of the total off-gas, up to about 50 percent, and preferably from 70 to 90 percent by volume, is passed from the absorber as the clean fuel gas previously described. A hot carbonate process as described, for example, in said U.S. Pat. No. 2,886,405 and in "The Purification of Coal-Derived Gases," by D. H. McCrea and J. H. Field, Applicability and Economics of Benfield Processes, American Inst. of Chem. Engineers, Salt Lake City, pp. 11 and 19, August, 1974, can be used in this first absorber and regenerator. Absorption conditions are selected such that the first absorber is more selective for hydrogen sulfide than carbon dioxide. McCrea and Field describe a hot carbonate process where about 99 percent of the hydrogen sulfide and 20 to 30 percent of the carbon dioxide can be removed. However, it will be apparent to those skilled in the art that other selective processes such as Rectisol, MEA (monoethanol amine) and DEA (diethanol amine) can be used to selectively remove hydrogen sulfide from gas streams.

The fuel gas stream from the first absorber can be used as a fuel for burning, since it is now essentially free of hydrogen sulfide. However, it will only have a heating value of about 65 Btu/SCF with partial carbon dioxide removal and could be burned only with specially designed combustion devices. The lean fuel gas, in a preferred embodiment, is further upgraded by splitting it into two portions. The first portion up to about 75 percent, preferably 25 to 60 percent by volume, is compressed to about 500 psig and enters a second absorber. For example, if approximately 50 percent of the lean clean fuel is passed to a second absorber, and all of the carbon dioxide is removed a rich, clean fuel gas of about 115 Btu/SCF can be produced. This rich gas can then be blended with a remaining portion of the lean gas to give a blended fuel gas of about 85 Btu/SCF. It is apparent that all of the lean fuel gas could be passed to the second absorber to be freed of carbon dioxide. However, it is only necessary to process a sufficient portion such that a satisfactory quality gas can be made by blending.

The first absorber and regenerator is designed to remove a substantial portion of the hydrogen sulfide, about 90 to about 100, preferably from about 95 to 99.5 percent, and a portion of the carbon dioxide, about 20 to 70 percent, preferably about 40 to 60 percent, for recycle.

The second absorber and regenerator is used to adjust the fuel gas quality of the product and to provide additional amounts of carbon dioxide for recycle. The second regenerator also allows for venting carbon dioxide into the atmosphere without sulfur pollution.

DETAILED DESCRIPTION OF DRAWING

Referring to FIG. 1, a molecular oxygen-supplying gas is introduced via line 2 and is combined with recycle carbon dioxide and hydrogen sulfide from line 42 and the resulting mixture is introduced into a compressor 4 and passed via line 6 into an in-situ retort 8. The gas mixture flows downward through the retort passing through the spent shale zone 10, the combustion zone 12 where carbonaceous residue on spent retorted shale is burned, and where sulfur is permanently fixed and carbon dioxide is produced, through a retort zone 14 where shale oil and gaseous hydrocarbons are formed and where additional hydrogen sulfide is produced, and finally through the cooler fragmented shale zone 16 where vaporized shale oil is cooled to a liquid. Shale oil and an off-gas leave the retort via line 18 and enter a separator 20 which separates the shale oil which goes to refining via line 22. An off-gas consisting of carbon dioxide, hydrogen sulfide, gaseous hydrocarbons, and other combustion and inert gases leaves the separator via line 24 and enters a compressor 26. These gases leave the compressor via line 28 and enter a recycle gas absorber 30, also called a first absorber herein, in which they are contacted with a solution for removing hydrogen sulfide and a portion of the carbon dioxide. Gaseous hydrocarbon and other combustion and inert gases and the remaining portion of the carbon dioxide leave the recycle gas absorber via line 22, and, together these gases comprise a clean fuel gas which is substantially free of hydrogen sulfide. A rich solution containing the hydrogen sulfide and carbon dioxide gas, for example, in the form of potassium bicarbonate and potassium hydrogen sulfide, leaves the first absorber via line 34 and enters a first regenerator 36 in which the carbon dioxide and hydrogen sulfide are removed from solution. A lean solution, which is now free of carbon dioxide and hydrogen sulfide, is returned to the recycle gas absorber, or first absorber, via line 38. Carbon dioxide and hydrogen sulfide leave the regenerator via line 40 and are recycled to line 42 and ultimately join a stream containing a molecular oxygen supplying gas in line 2. The clean fuel gas leaving in line 32 is split, in a preferred embodiment, into two portions by means of a valve 44. A first portion of lean fuel gas enters line 46. A second portion of the clean fuel gas enters via line 48 into a compressor 50 where it is compressed before entering via line 52 a second absorber 54 using a solution which is selective for removing carbon dioxide. The second absorber thus acts as a fuel gas adjuster and removes carbon dioxide from the lean fuel gas. Gaseous hydrocarbons and combustion and inert gases, now free of carbon dioxide, leave the absorber 54 via line 56 as a rich fuel gas. The rich fuel gas in line 56 is combined with a portion of lean fuel gas in line 46 to give a medium quality fuel gas which can be burned in other refining processes. A rich solution containing carbon dioxide, for example, in the form of potassium bicarbonate, in line 58 is stripped of carbon dioxide in regenerator 60. The lean solution, free of carbon dioxide, is returned to absorber 54 via line 62. Essentially pure carbon dioxide leaves the second regenerator 60 via line 62, passes through a valve 64, and can enter the atmosphere via line 66. A portion of the carbon dioxide separated by valve 64 can be recycled to the retort via line 42.

Obviously, many modifications and variations of the invention, as hereinabove set forth, can be made without departing from the spirit and scope thereof, and therefore only such limitations should be imposed as are indicated in the appended claims.

We claim:

1. An improved in-situ retorting process for recovering shale oil from a subsurface oil shale deposit and producing a gas of low sulfur content and increased heating value comprising the steps of:

(1) mining a first portion of said shale to form a void space in the shale deposit;

(2) fragmenting a second portion of said shale and expanding said second portion into the void space to form a rubblized in-situ retort;

(3) retorting the rubblized shale in the retort by passing downwardly through the retort a molecular oxygen supplying gas while maintaining a retort temperature adapted to convert kerogen in shale in the retort to shale oil and to produce an offgas containing carbon dioxide, hydrogen sulfide, gaseous hydrocarbons and other combustion and inert gases;

(4) separating said shale oil from said offgas;

(5) separating hydrogen sulfide and a first portion of said carbon dioxide from said offgas to produce a clean fuel gas of low sulfur content and increased heating value; and (6) recycling the separated hydrogen sulfide and carbon dioxide to step (3).

2. An improved process according to claim 1 wherein shale equal to about 10 to about 50 percent of the volume of the retort is mined and removed from the deposit.

3. An improved process according to claim 1 wherein shale equal to about 15 to about 30 percent of the volume of the retort is mined.

4. An improved process according to claim 1 wherein said molecular oxygen-supplying gas is selected from the group consisting of air and oxygen.

5. An improved process according to claim 1 wherein said retorting of shale is conducted at a temperature ranging from about 425° to about 1150° C.; a pressure ranging from about 2 to about 100 psia; a gas flow rate of about 5,000 to about 20,000 SCF/ton of shale; and a gas molar ratio of $O_2$:$CO_2$:$H_2S$ ranging from about 10:20:0.05 to about 30:65:0.30.

6. An improved process according to claim 1 wherein said retorting of shale is conducted at a temperature ranging from about 300° to about 600° C.; a pressure ranging from about 2 to about 30 psia; a gas flow rate of about 7,000 to about 15,000 SCF/ton of shale; and a gas molar ratio of $O_2$:$CO_2$:$H_2S$ ranging from about 12:25:0.05 to about 18:35:0.30.

7. An improved process according to claim 1 wherein said retorting of shale is conducted at a temperature ranging from about 425° to about 1150° C.; a pressure ranging from about 2 to about 100 psia; a gas flow rate of about 5,000 to about 20,000 SCF/ton of shale; and a gas molar ratio of Air:$CO_2$:$H_2S$ ranging from about 15:20:0.05 to about 100:65:0.30.

8. An improved process according to claim 1 wherein said retorting of shale is conducted at a temperature ranging from about 300° to about 600° C.; a pressure ranging from about 2 to about 30 psia; a gas flow rate of about 7,000 to about 15,000 SCF/ton of shale; and a gas molar ratio of Air:$CO_2$:$H_2S$ ranging from about 17:25:0.05 to about 88:35:0.30.

9. An improved process according to claim 1 wherein said hydrogen sulfide and said first portion of carbon dioxide is separated from said gaseous hydrocarbons and other combustion and inert gases and said second portion of said carbon dioxide, by absorption in a hot potassium carbonate solution.

10. An improved process according to claim 1 wherein about 90 to about 100 percent by volume of said hydrogen sulfide and about 20 to about 70 percent by volume of carbon dioxide is removed in step (5).

11. An improved process according to claim 1 wherein about 95 to about 99.5 percent by volume of said hydrogen sulfide and about 40 to about 60 percent by volume of carbon dioxide is removed in step (5).

12. An improved process as set forth in claim 1 wherein the clean fuel gas from step (5) is divided into a first stream and a second stream, carbon dioxide is removed from the first stream, and the first stream after removal of the carbon dioxide is blended with the second stream.

13. A process as set forth in claim 12 wherein the first stream constitutes 25 to 60 percent by volume of the clean fuel gas.

* * * * *